US006523184B2

(12) United States Patent
Prisco

(10) Patent No.: US 6,523,184 B2
(45) Date of Patent: Feb. 25, 2003

(54) TOILET VENTILATION SYSTEM

(75) Inventor: Anthony Prisco, Las Vegas, NV (US)

(73) Assignee: Delpriss Management Services, Inc., Las Vegas, NV (US)

( * ) Notice: Subject to any disclaimer, the term of this patent is extended or adjusted under 35 U.S.C. 154(b) by 0 days.

(21) Appl. No.: 09/940,300

(22) Filed: Aug. 27, 2001

(65) Prior Publication Data

US 2002/0032923 A1 Mar. 21, 2002

Related U.S. Application Data

(63) Continuation of application No. 09/070,103, filed on Apr. 28, 1998, now abandoned.

(51) Int. Cl.[7] ..... E03D 9/052
(52) U.S. Cl. ..... 4/213; 4/217
(58) Field of Search ..... 4/213, 217

(56) References Cited

U.S. PATENT DOCUMENTS

| | | | | | |
|---|---|---|---|---|---|
| 1,122,264 | A | | 12/1914 | Douglas | 4/217 |
| 1,173,520 | A | * | 2/1916 | Hunter | 4/217 |
| 1,213,113 | A | | 1/1917 | Lange, Jr. | 4/352 |
| 1,614,622 | A | * | 1/1927 | Mahnken | 4/213 |
| 1,630,524 | A | | 5/1927 | Bruder | 4/217 |
| 1,794,625 | A | | 3/1931 | Mills | 4/217 |
| 1,887,498 | A | | 11/1932 | Connors | 4/213 |
| 2,079,733 | A | | 5/1937 | Cummings | 4/213 |
| 2,309,885 | A | * | 2/1943 | Carman | 4/213 |
| 2,342,714 | A | | 2/1944 | Wheeler | 4/216 |
| 2,519,286 | A | * | 8/1950 | Riedele | 4/217 |
| 2,747,201 | A | | 5/1956 | Herriott | 4/213 |
| 3,192,539 | A | | 7/1965 | Martz | 4/218 |
| 3,359,884 | A | | 12/1967 | Statter | 4/215 |
| 3,386,109 | A | | 6/1968 | Christian | 4/213 |
| 3,590,401 | A | | 7/1971 | Brown | 4/236 |
| 3,626,554 | A | | 12/1971 | Martz | 4/213 |
| 3,824,637 | A | | 7/1974 | Hunnicutt | 4/213 |
| 3,896,509 | A | | 7/1975 | Stipp | 4/209 |
| 3,916,459 | A | | 11/1975 | Ivancevic | 4/213 |
| 4,007,498 | A | | 2/1977 | Pearson | 4/213 |
| 4,125,906 | A | | 11/1978 | Weiland | 4/217 |
| 4,165,544 | A | | 8/1979 | Barry | 4/213 |
| 4,175,293 | A | | 11/1979 | Stephens | 4/209 |
| 4,232,406 | A | | 11/1980 | Beeghly | 4/213 |
| 4,251,888 | A | | 2/1981 | Turner | 4/213 |
| 4,402,091 | A | | 9/1983 | Ellis | 4/217 |
| 4,416,048 | A | | 11/1983 | Otte | 29/526 R |
| 4,556,999 | A | | 12/1985 | Lindley | 4/217 |
| 4,617,687 | A | | 10/1986 | Wadsworth | 4/213 |
| 4,620,329 | A | | 11/1986 | Wix | 4/217 |
| 4,701,966 | A | | 10/1987 | Schafer | 4/213 |
| 4,780,913 | A | | 11/1988 | Williams | 4/217 |
| 4,882,790 | A | | 11/1989 | Ricard | 4/213 |
| 4,939,796 | A | | 7/1990 | Pepper | 4/236 |
| 4,944,045 | A | | 7/1990 | Agelatos | 4/213 |
| 4,984,310 | A | | 1/1991 | Cassale | 4/347 |
| 4,985,939 | A | | 1/1991 | Otte | 4/240 |
| 5,010,600 | A | | 4/1991 | Prisco | 4/217 |
| 5,016,294 | A | | 5/1991 | Canovas | 4/217 |
| 5,170,512 | A | | 12/1992 | Prisco | 4/213 |
| 5,199,111 | A | | 4/1993 | Antepenko | 4/213 |
| 5,253,371 | A | | 10/1993 | Slawinski | 4/213 |
| 5,259,072 | A | | 11/1993 | Trombley | 4/213 |
| 5,355,536 | A | | 10/1994 | Prisco | 4/217 |
| 5,491,847 | A | | 2/1996 | Shaffer | 4/213 |

FOREIGN PATENT DOCUMENTS

| | | |
|---|---|---|
| FR | 2630318 | 10/1989 |

* cited by examiner

*Primary Examiner*—Robert M. Fetsuga
(74) *Attorney, Agent, or Firm*—Weide & Miller, Ltd.

(57) ABSTRACT

Disclosed is a ventilation device for removing offensive odors from within and near the toilet bowl, incorporating a modular asymmetrical exhaust airway to permit retrofitting onto a variety of toilet designs. The device may be used with a specially-designed toilet seat containing an internal duct and air outlets on its lower surface, or it may be used with a standard toilet seat by drawing gases from the bowl, through the space between the seat and the rim of the bowl, yet above the flood rim level specified in many plumbing codes. The invention also includes an easily disassemble design for sanitary cleaning.

15 Claims, 8 Drawing Sheets

TOILET VENTILATION SYSTEM

RELATED APPLICATION DATA

This application is a continuation of U.S. application Ser. No. 09/070,103, filed Apr. 28, 1998, abandoned.

FIELD OF THE INVENTION

The invention relates to the fields of plumbing and ventilation, and more particularly, to the ventilation of toilets and bathrooms.

BACKGROUND OF THE INVENTION

The need to remove unpleasant odors from the toilet areas has been with us since long before the invention of the flush toilet. To date, no one has developed a commercially successful method improving upon whole-room ventilation systems (i.e.. whole-room exhaust fans). Yet the need persists. Ventilation proximal to the source of odoriferous emissions would yield may benefits, including inter alia improved evacuation of odors and energy savings. This invention provides a device which overcomes the disadvantages of prior attempts to achieve toilet bowl ventilation, while improving on the currently predominant technology of exchanging large volumes of room air merely to eliminate a relatively small volume of methane. The device, unlike earlier attempts by others, meets all the present-day plumbing, fire and building codes in the United States of which the inventor is aware.

Modern building codes require exhaust systems in rooms housing toilets. Exhaustion of room air, typically from the ceiling, requires the exchange of large quantities of air, and does not necessarily protect occupants from unpleasant odors. This particularly true in public rest rooms and hotel bathrooms. Moreover, the exhaustion of a sufficient quantity of room air to create an acceptably odor-free environment created increased energy loads on buildings due to the influx of un-heated or un-air-conditioned air from the outdoors. Additionally, exhaustion at the source will eliminate the vast majority of methane and associated odors from the building's heating ventilation and air conditioning system.

While there has been a steady stream of inventive activity related to methods, of locally ventilating a toilet, none have yet met commercial success. This may be partly due to the difficulty in manufacturing and installing such devices, but also due to the fact that many, if not most, fail to meet applicable building codes. In addition, prior technology fails to effectively deal with the variety of existing toilet configurations and designs. The present invention incorporates a modular integrated design to permit retrofitting onto a wide variety of toilet conformations, while providing an aesthetically pleasing, and sanitary finishing installation.

Several patents have been awarded for inventions incorporating exhaust pathways into the toilet seat itself. For example, U.S. Pat. No. 3,916,459 granted to Ivancevic teaches a hollow hinge mechanism drawing contaminated air from the rear portion of the top surface of a toilet seat. Ivancevic also claims a switch mechanism to automatically switch on electronically-powered exhaust fan when the user is seated. In addition, Ivancevic teaches exhausting the gaseous waste into the plumbing system via specialized plumbing adapters. This design presents significant electrical and plumbing code compliance problems, as well as being highly complex to fabricate and install. Such a design would be difficult to retrofit into an existing laboratory.

U.S. Pat. No. 4,125,906 granted to Weiland also described a special toilet seat incorporating exhaust pathways.

Weiland's toilet seat contains an inner conduit communicating to the interior of the bowl through a series of ports, and venting to an exhaust fan through a specialized hinge containing an articulating air passageway. Such a mechanism would be difficult to fabricate so as to fit existing toilet designs, and would create a sanitary problem in that no means is provided for cleaning the interior of the vented toilet seat.

U.S. Pat. No. 1,794,635 granted to Mills described a similar mechanism to Weiland, having an exhaust port incorporated into a hinge mechanism but also incorporating a mechanical cut-off to the air flow when the seat is raised. However, the Mills invention requires specialized manufacture of the porcelain china bowl to accommodate the mechanism. This is considered impractical for most applications.

U.S. Pat. No. 4,251,888 granted to Turner also incorporates ventilation ducts within the toilet seat, connected to an exhaust fan. However, the invention described by Turner places the electrical exhaust fan motor below the flood rim level of the fixture, violating building codes and creating a potential electrical hazard. Additionally, the Turner patent describes an electrical switch when built into the lower portion of the seat designed to turn the exhaust fan on automatically when the weight of a person is placed upon the seat. This adds an additional electrical hazard and code violation. The spring-loaded switch itself would also present a significant sanitary cleaning problem as it would accumulate filth and be difficult to sanitize.

U.S. Pat. No. 4,556,999 granted to Lindley incorporates internal exhaust airways, but adds a means to intake fresh, turbulent air. However, the Lindley invention teaches the use of a vacuum source rather than an exhaust fan, and utilizes a relatively small diameter exhaust passageway. As a result, the Lindley invention would be quite noisy if operated so as to remove a sufficient quantity of air ti effectively remove unpleasant odors and noxious methane. Additionally, it would consume significantly more electricity than a system using wider ducts and an exhaust fan.

Several patents have also been awarded which describe exhaust systems external to the seat itself. For example, U.S. Pat. No. 3,386,109 granted to Christian describes an elongated intake member attached to the underside of the seat, collecting air to be deodorized by a filter external to the toilet. However, the activated charcoal filter described in the Christian patent requires periodic replacement. Further, while it may remove unpleasant odors, it would not necessarily effectively remove noxious and flammable methane from the interior of the building. It further occupies significant space within the room housing the toilet, and may present an electrical hazard.

U.S. Pat. No. 4,175,293 granted to Stephens described a exhaust hood projecting into the toilet bowl, beneath the seat, and a seat-hinge mechanism incorporated into the sides of the hood. However, in the Stephen's invention, the intake is blow the flood rim, violating plumbing codes and presenting the hazard of causing over-flowing water to be drawn into the described system.

Similarly, U.S. Pat. No. 3,824,637 granted to Hunnicutt describes a collector unit essentially consisting of a generally flat airway protruding below the seat, intended to draw air into a separate activated charcoal unit. However, since the Hunnicutt invention draws from a single location at the rear of the bowl, like some of the other patents discussed, it will not effectively eliminate all odors from escaping from the front and sides of the bowl.

U.S. Pat. No. 4,701,966 granted to Schafer describes a plastic disposable duct located between the toilet seat and the rim of the bowl, with vacuum ports in a protruding lip on the inner portion of the ring. The ring is connected to a T-shaped vacuum base member with scored segments on the T-outlets to permit shortening. While the Ellis device is an attempt to solve the ineffective collection problems of such devices as Schafer and Hunicutt, it fails to meet plumbing code requirements because it draws air from below the flood rim level. Additionally, by raiding the seat, it introduces structural instability.

Other attempts at designing odor-eliminating systems have approached the problem by using the existing plumbing elements of a toilet in a manner to exhaust air. See, for example U.S. Pat. No. 3,192,539 granted to Marz and U.S. Pat. No. 4,165,544 granted to Barry. These approaches fail to meet plumbing code restrictions because they introduce what is considered sewer gas into potable water systems. Therefore, they may not be implemented in most locations in the United States because they pose the threat of contaminating the domestic potable water.

None of the foregoing attempts at solving the toilet ventilation problem has ever met with the commercial success because each wither requires specialized manufacture of conmmodes, or, if not retrofitted onto existing designs, is difficult to install, aesthetically displeasing and does not meet applicable plumbing, electrical and building codes. Moreover, prior art retrofit approaches will not fit an adequately broad range of existing toilet designs and configurations. Nor are any of the prior are designs conductive to sanitary cleaning. Only the '966 patent described a disposable device aimed at sanitary concern.

One of the physical limitations related to retrofitting an exhaust system having an element such as an exhaust manifold located between the toilet seat and the toilet tank is the lack of physical space due to the presence of toilet seat mounting hardware, normally hinges. It would be desirable to provide an exhaust pathway which would physically fit directly behind a standard toilet seat without the need to specially manufacture a commode with additional clearance between the rear seat and the tank.

It is therefore an object of this invention to provide a system for directly ventilating a toilet bowl without the need to manufacture a specialized commode.

It is a further object of the present invention to provide a system for easily retrofitting a wide variety of existing toilet designs with a bowl-ventilation device.

It is a further object of the present invention to provide a system for retrofitting a toilet bowl ventilation device in an aesthetically-pleasing way.

It is a further object of the present invention to provide a toilet bowl ventilation device which will meet the majority of present-day plumbing, fire, electrical and other building codes.

It is a further object of the present invention to provide a toilet bowl ventilation device which can be effectively cleaned.

It is a further object of the present invention to provide a toilet bowl ventilation device which is both suitable for both retrofitting and new construction.

It is a further object of the present invention to provide a toilet bowl ventilation device which permits clearance for a toilet seat mounting hardware while providing a manifold between the ear of the toilet seat and the toilet tank.

SUMMARY OF THE INVENTION

This invention relates to a toilet bowl ventilation system which can be retrofit on a variety of toilet bowl configurations.

DESCRIPTION OF THE DRAWINGS

This invention may be best understood by reference to the drawings, in which.

DETAILED DESCRIPTION OF THE INVENTION

Figure 1:
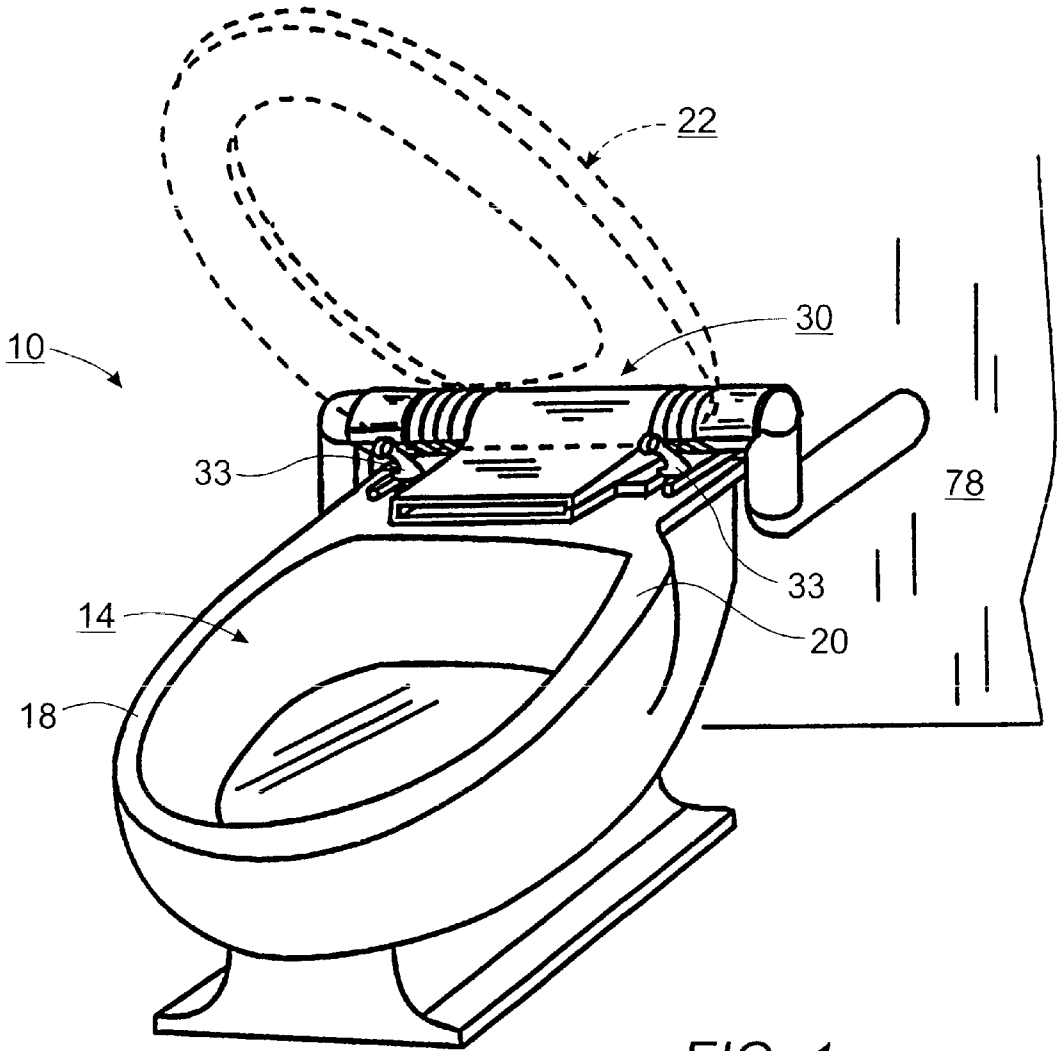
FIG. 1 is a perspective view of a toilet having a ventilation system embodying the present invention.
Figure 2:
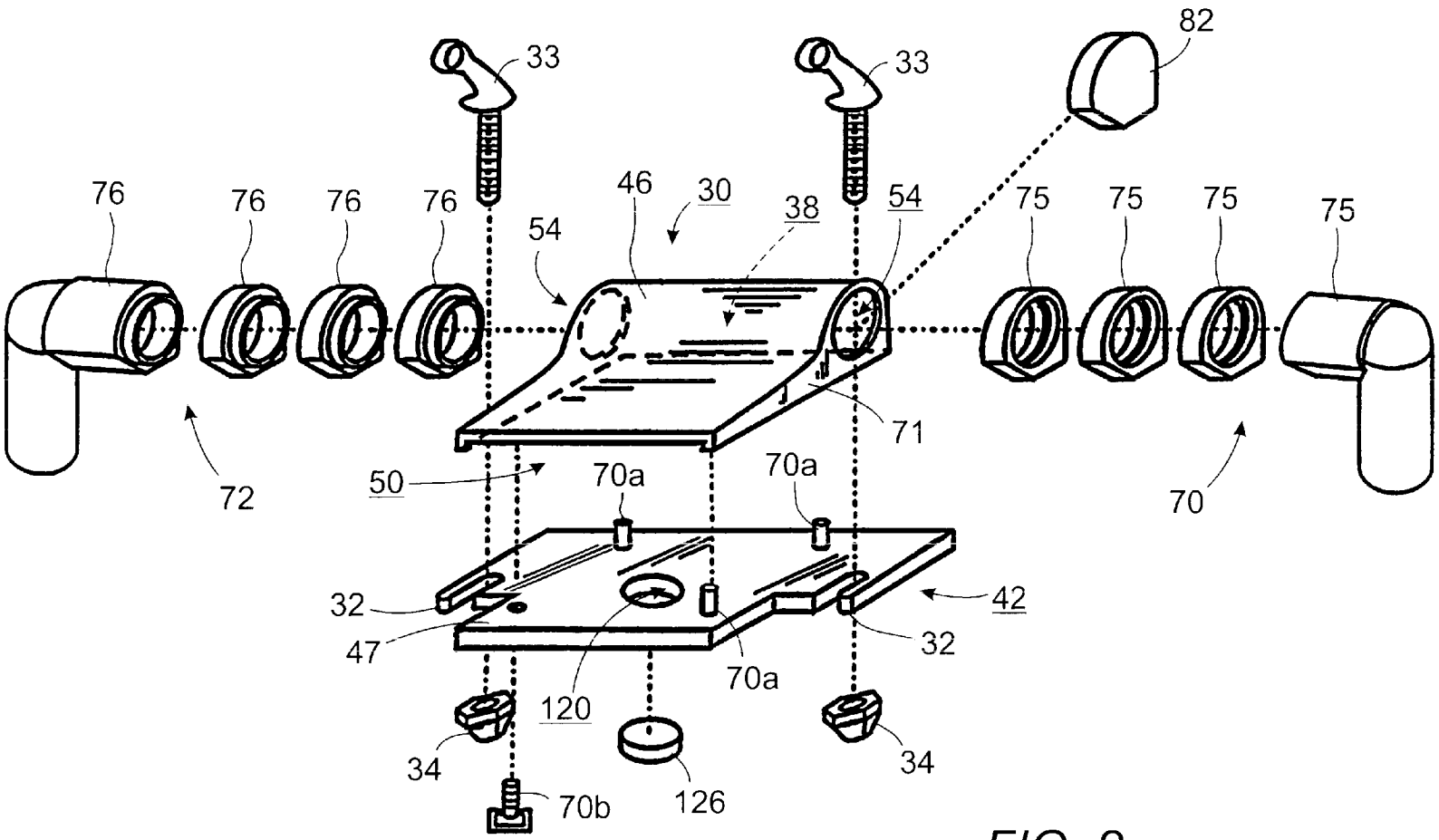
FIG. 2 is a perspective view of an exhaust plenum of the type described herein.

Referring to FIGS. 1 and 2 there is illustrated a toilet 10 comprising a toilet bowl 14 having an upwardly extending rim 18, an upper rear horizontal plate 20, a toilet seat 22 fastened to the bowl 14 by means of hinges 26 and an exhaust manifold 30 retained by the hinges 26. The exhaust manifold is generally T-shaped.

In FIG. 2 it may be seen that the exhaust manifold 30 is fastened to the bowl by inserting mounting arms 32 under the hinge bolt shoulder 33 and then tightening the hinge mounting bolt-nut 34. The exhaust manifold 30 comprises several-molder plastic pieces as follows: The hollow air plenum 38 is a combination of a base plate 42 and an upper cap piece 46 forming thereby a hollow space with an intake orifice 50. The lower plate 42 of the hollow air plenum 38 is a minimum of ⅜" thick to keep the lowest margin 47 of the intake orifice 50 above the "flood rim level" defined by many plumbing codes. The base plate 42 also incorporates the mounting arms 32 as integral extensions of the lower plate. The upper cap piece 46 defines the sides and top of the air intake or orifice 50 and contains an exit port 54 on each side. The outside vertical dimension of the hollow air plenum 38 at the front end (which is location of the intake orifice 50) is approximately ⅜" excluding the thickness of the base plate 42, and nominally 1⅝" to 2" at the back end 62 (see FIG. 3)opposite the intake orifice 50. The upper cap piece 46 may be separated from the base plate 42 and exhaust ducts 70,72 for ease of cleaning. The base plate 42 may be attached to the upper piece 46 by means of snaps 70*a* incorporated into the components parts. Alternatively, rotationally-engaging fasteners 70*b* may be employed.

Each of the two vertical sides 71 of the hollow air plenum 38 incorporates one port 54 adapted to accept an exhaust duct 70,72. As illustrated in FIG. 2, one or more of the modular units 75,76 are connected to one another to form each of the ducts 70,72, which when assembled, appear as illustrated in FIG. 1. Also illustrated, one of the modular units 75,76 is connected to the cap piece 46 at the port 54, thus connecting the duct 70,72 to the remainder of the manifold 30. In this manner, each duct 70,72 is of modular design to permit it to be assembled in a multiplicity of lengths and thus fit a wide variety of toilet bowl designs. The modular units 75, 76 may be rotated in relation to one another to provide flexibility of installation. Specifically, a 90 degree elbow normally terminates at least one of the air ducts, and may be rotated to adjust the height above floor level the air ducts enter the wall 78 behind the toilet 10. If desired, one of the exhaust air ducts may be omitted and the port 54 in the side of the hollow air plenum 38 plugged with a specially adapted terminating plug 82.

Figure 3:
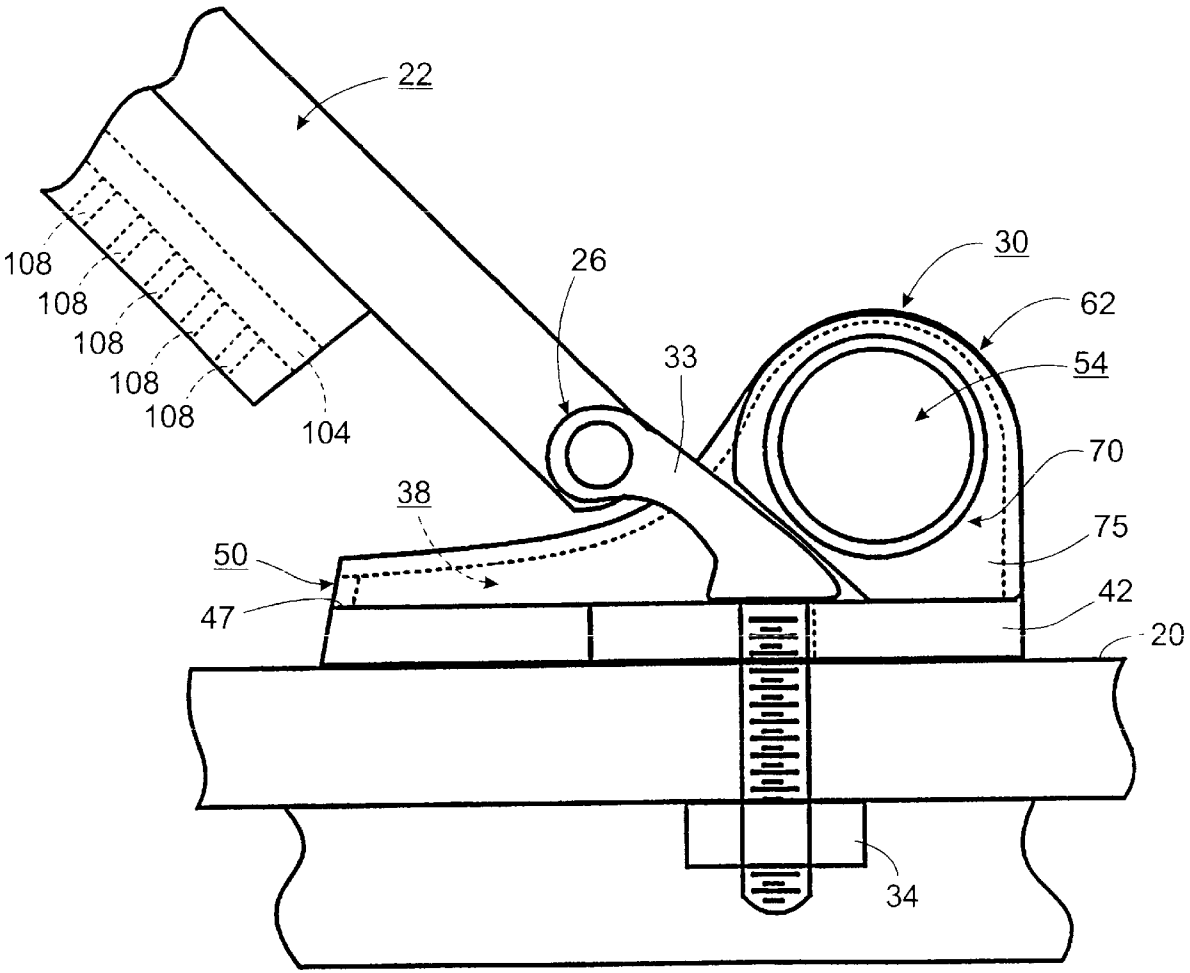
FIG. 3 is an enlarged elevational cross-sectional view of toilet incorporating an exhaust system embodying the present invention, specifically showing the toilet in an "up position."

FIG. 3 illustrates that the upper cap piece 46 provides clearance for the toilet seat 22 when in the position. The width of the hollow air plenum is approximately 3½ to 4" to permit its location between the seat hinges 26.

Figure 4A:
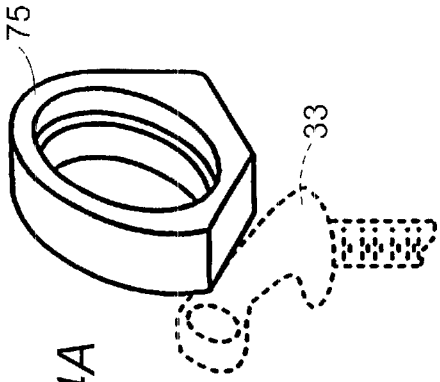
FIGS. 4*a* and 4*b* show two perspective views of a modular unit in association with a seat hinge.
Figure 4B:
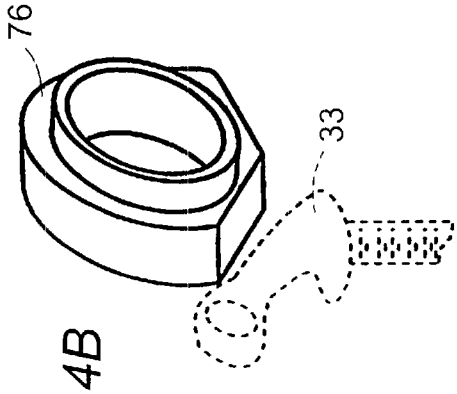

FIGS. 4*a* and 4*b* show two views of the asymmetrical exhaust duct modular units 75,76 which are specially adapted to permit clearance for the toilet seat hinge bolt shoulder 33.

Figure 5:
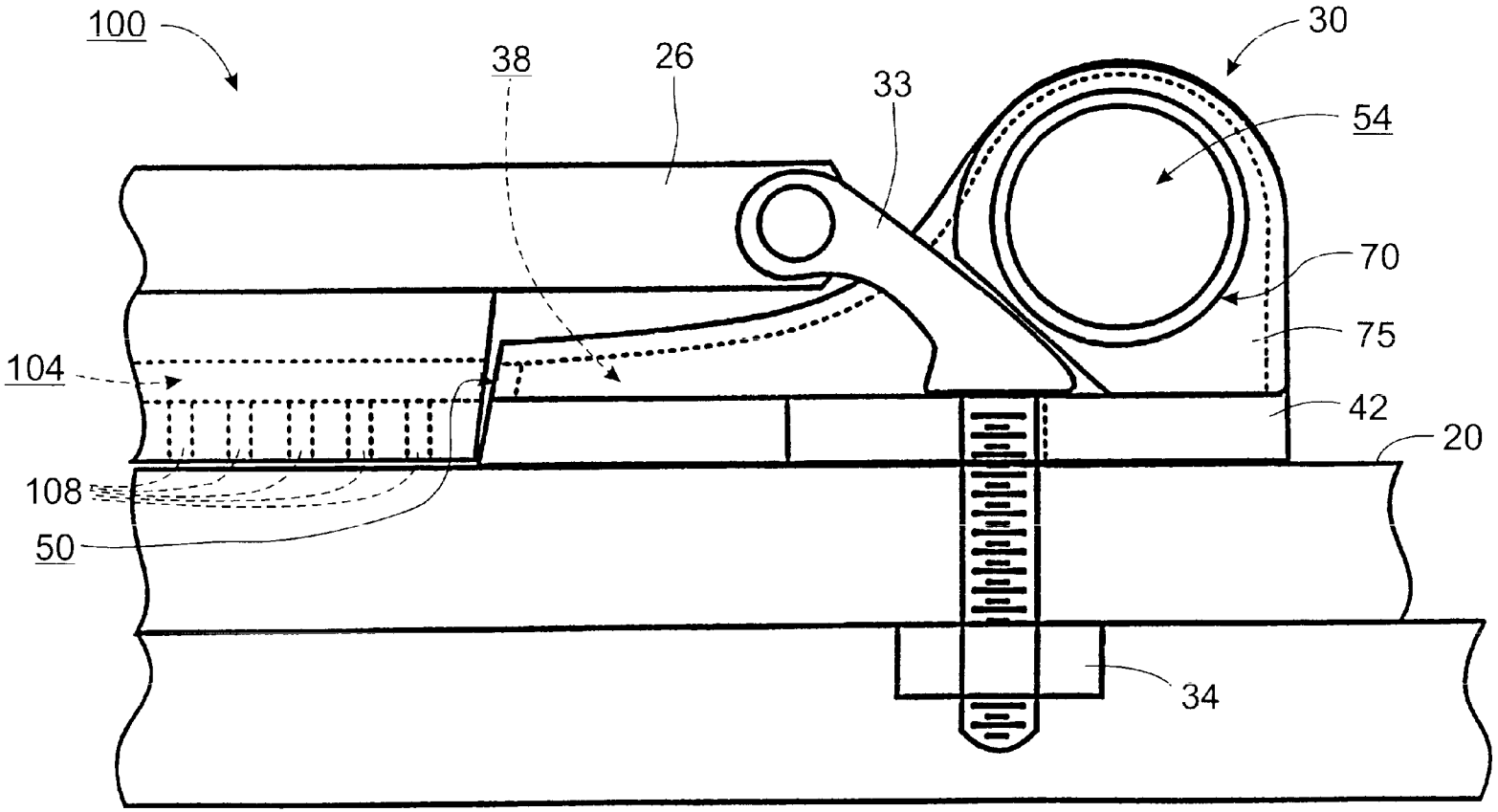
FIG. 5 is a cross sectional view of the present invention showing the seat in the "down" position.

FIG. 5 illustrates that the present invention communicates with a hollow toilet seat 100. When the seat is in the lowered position, the intake orifice 50 of the hollow air plenum 38 aligns with a matching orifice 104 in a hollow seat 100 to permit the contained movement of air from within the seat into a hollow air plenum 38. Additional intake orifices 108 are incorporated into the lower surface of the seat so that air may be drawn from the interior of the bowl 14, into the hollow seat 100, through the intake orifice 50, through the hollow air plenum 38, through the exit ports 54, through the exhaust ducts 70, and, ultimately, to the outdoors.

Figure 6:
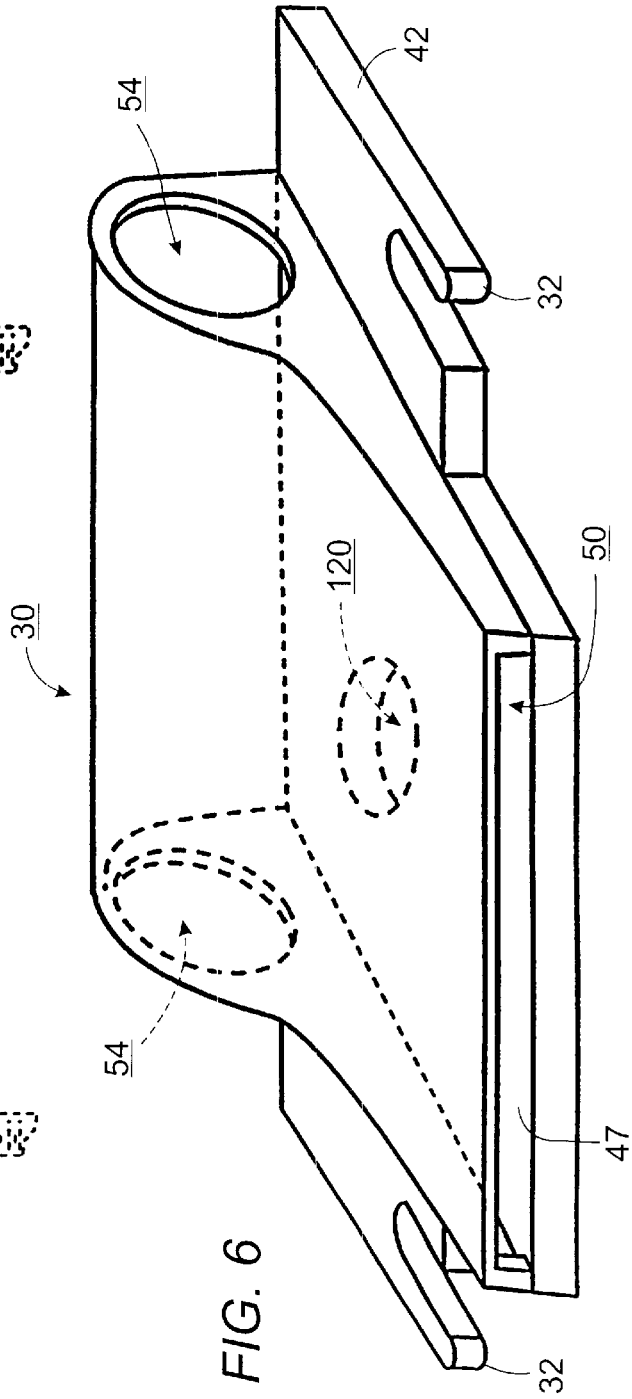
FIG. 6 is a perspective view of the hollow air plenum showing an alternative embodiment.
Figure 7:
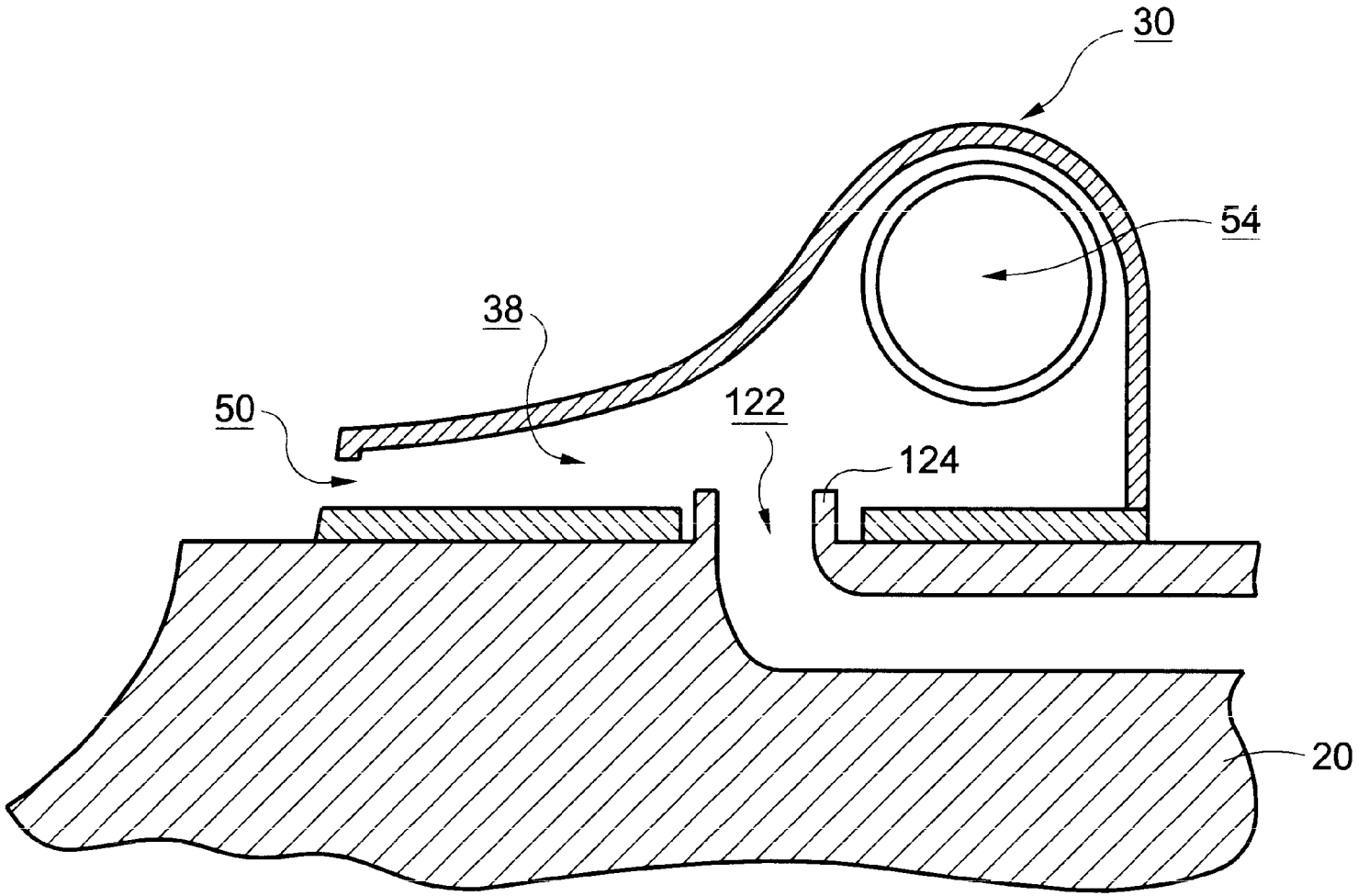
FIG. 7 is a cross sectional view of an alternative embodiment showing incorporation of an airway within the toilet communicating with the lower surface of the hollow air plenum.

FIGS. 6 and 7 illustrate a variation of the invention incorporates a third exhaust port 120 in the lower surface of the exhaust manifold 30. The third exhaust port 120 mates to a specially provided exhaust orifice 122 in the upper surface of the toilet bowl, generally behind and between the toilet seat mounting hinges 26. Reference to FIG. 7 illustrates that the special exhaust orifice 122 must normally be incorporated in the manufacture of the toilet bowl due to the great difficulty in retrofitting such a hole. Additionally, to meet plumbing codes, an upwardly extending lip 124 must be provided to keep the opening port 120 above the "flood rim level." To provide flexibility on different installation configurations, the third exhaust port 120 may be created by removing a preformed punch-out plug 126 incorporated into the lower surface of the exhaust manifold 30. In this embodiment, one or both sides of the port 54 may be plugged off to permit a broader range of installation options and improve aesthetic appeal.

Figure 8:
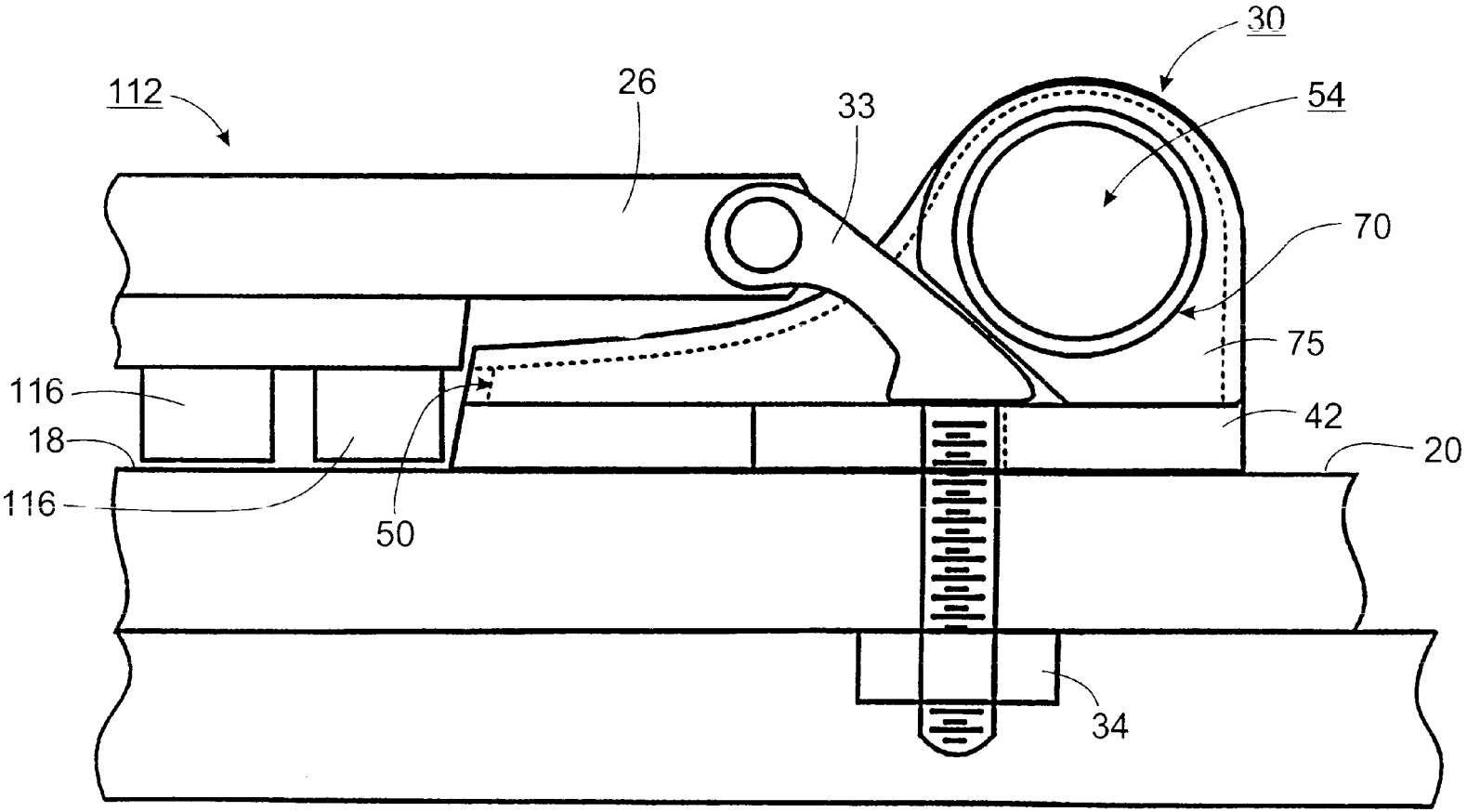
FIG. 8 is a cross sectional view of an alternative embodiment showing the use of a solid (rather than hollow) toilet seat.

FIG. 8 shows that, in an alternative embodiment, a standard solid toilet seat 112 may be used in place of a special hollow seat 100. In such installation, the seat height above the bowl rim 18 is adjusted with shims or spacers 116 to a minimum of approximately ½" to ⅝", permitting the intake orifice 50 to draw air from between the bowl rim 18 and the lower surface of the toilet seat 112.

Figure 9:
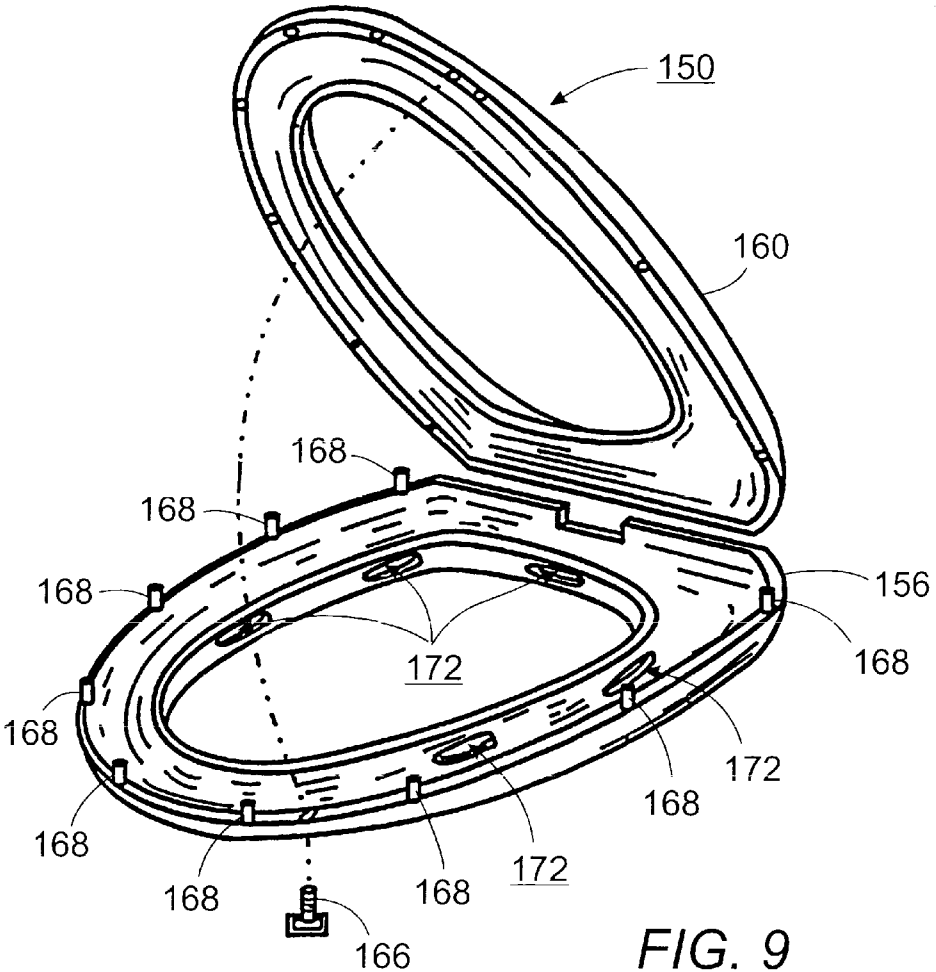
FIG. 9 is an exploded view of an alternative embodiment showing openable hollow toilet seat assembly.

FIG. 9 illustrates an alternative embodiment incorporating a hollow toilet seat 150 capable of being opened for ease of cleaning. The seat is formed by a lower portion 156 attached to an upper portion 160 by means or rotationally engaging fasteners 166, snap fasteners 168, or the like.

While this invention has been described by examples of the specific embodiments, it will be understood that it is not intended to limit the invention to the examples described. To the contrary, it is intended to cover all alternatives, modifications and equivalents as may be included within the spirit and scope of the invention as defined by the appended claims. It is clear that this invention is susceptible to numerous modifications and embodiments within the ability of those skilled in the art and without the exercise of the inventive process. Accordingly, the invention should not be limited by the foregoing description, but should be defined only be the appended claims.

What is claimed is:

1. A toilet area gaseous exhaust system comprising:

at least one manifold having a lower surface, at least one inlet, a first port and a second port, said first and second ports being mutually opposed and generally perpendicular to said at least one inlet, said at least one inlet comprising at least one orifice; and an exhaust duct leading from at least one of said first and second ports, said exhaust duct of a modular design including modular units assembled as illustrated in FIG. 1 and terminating in an elbow.

2. The toilet area gaseous exhaust system in accordance with claim 1 wherein said modular units are asymmetrically shaped as illustrated in FIG. 3 to accommodate a shoulder of a hinge bolt used to fasten a toilet seat to a toilet bowl.

3. The toilet area gaseous exhaust system in accordance with claim 1 wherein said manifold comprises a base plate and an cap piece connected to said base plate.

4. The toilet area gaseous exhaust system in accordance with claim 1 wherein said first and second modular units are rotatable with respect to one another.

5. The toilet area gaseous exhaust system in accordance with claim 1 wherein a terminating plug is connected to said manifold and closes at least one of said first and second ports.

6. A toilet area gaseous exhaust system comprising:

a manifold for mounting to a toilet bowl, said manifold comprising a base plate and a cap piece connected to said base plate, said manifold defining a hollow interior space, said manifold including an inlet comprising at least one orifice leading to said interior space, said cap piece having a first side and an opposing second side, a first port in said first side and a second port in said second side, said first and second port facing in generally opposing directions and generally perpendicular to the inlet; and an exhaust duct extending from at least one of said ports, said exhaust duct of a modular design constructed from modular units as illustrated in FIG. 1.

7. The toilet area gaseous exhaust system in accordance with claim 6 wherein said exhaust duct extends from said first port and a terminating plug is connected to said manifold and closes said second port.

8. The toilet area gaseous exhaust system in accordance with claim 6 wherein said exhaust duct is connected to said first modular adaptor.

9. The toilet area gaseous exhaust system in accordance with claim 6 wherein said modular units are asymmetrical, permitting clearance of a hinge bolt used to mount a toilet seat to said toilet bowl.

10. The toilet area gaseous exhaust system in accordance with claim 6 wherein said modular units are rotatable with respect to one another.

11. A toilet area gaseous exhaust system comprising:

a manifold for mounting to a toilet bowl, said manifold comprising a base plate and a cap piece connected to said base plate, said manifold defining a hollow interior space, said manifold including an inlet comprising at least one orifice leading to said interior space, said connected cap piece and base plate defining at least one orifice, said cap piece having a first side and an opposing second side, a first port in said first side and a second port in said second side, said first and second port facing in generally opposing directions and generally perpendicular to the inlet; and an exhaust duct connected to said first port and extending therefrom, said exhaust duct constructed from modular units as illustrated in FIG. 1 and said second port plugged with a terminating plug.

12. The toilet area gaseous exhaust system in accordance with claim 11 herein said base plate and cap piece are disconnectable.

13. The toilet area gaseous exhaust system in accordance with claim 11 wherein said modular units are rotatable with respect to one another.

14. The toilet area gaseous exhaust system in accordance with claim 11 wherein said modular units are asymmetrical in shape as illustrated in FIG. 3 to accommodate a hinge bolt used to mount a toilet seat to said toilet bowl.

15. The toilet area gaseous exhaust system in accordance with claim 11 wherein said exhaust duct terminates in an elbow.

* * * * *